US010787866B2

(12) United States Patent
Thomas et al.

(10) Patent No.: US 10,787,866 B2
(45) Date of Patent: Sep. 29, 2020

(54) SEGMENTED BEND-LIMITER FOR SLICKLINE ROPE SOCKETS AND CABLE-HEADS

(71) Applicant: Halliburton Energy Services, Inc., Houston, TX (US)

(72) Inventors: Sean Gregory Thomas, Georgetown, TX (US); Jack Gammill Clemens, Fairview, TX (US); Richard Mineo, Richardson, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 233 days.

(21) Appl. No.: 15/748,674

(22) PCT Filed: Nov. 18, 2015

(86) PCT No.: PCT/US2015/061227
§ 371 (c)(1),
(2) Date: Jan. 30, 2018

(87) PCT Pub. No.: WO2017/086943
PCT Pub. Date: May 26, 2017

(65) Prior Publication Data

US 2019/0003267 A1 Jan. 3, 2019

(51) Int. Cl.
*E21B 17/05* (2006.01)
*E21B 17/20* (2006.01)
(Continued)

(52) U.S. Cl.
CPC ..... *E21B 17/20* (2013.01); *E21B 17/05* (2013.01); *E21B 23/14* (2013.01); *E21B 33/072* (2013.01)

(58) Field of Classification Search
CPC ..... E21B 17/05; E21B 17/20; E21B 23/14; E21B 33/072
See application file for complete search history.

(56) References Cited

U.S. PATENT DOCUMENTS 254,809 A 3/1882 Martin
4,396,797 A 8/1983 Sakuragi et al.
(Continued)

FOREIGN PATENT DOCUMENTS

EP 1586922 B1 11/2008
GB 2269274 A 2/1994
(Continued)

OTHER PUBLICATIONS

International Searching Authority, Patent Cooperation Treaty, International Search Report and Written Opinion, International application No. PCT/US2015/061227, which is a PCT parent of the instant application, entire document, dated Aug. 18, 2016.

*Primary Examiner* — Daniel P Stephenson
(74) *Attorney, Agent, or Firm* — McGuirewoods, LLP

(57) ABSTRACT

A chain of bend-limiter segments is coupled together. The chain has a first end and a second end. The chain is bendable such that an angle between the first end and the second end is at least N degrees and a radius of curvature of the chain is at least M. A cable is inserted through the chain from the first end to the second end. The chain and the cable are coupled to a tool. The tool is pulled using the cable. The chain maintains a radius of curvature of the cable greater than M and prevents a stress level in the cable from exceeding a yield point.

8 Claims, 8 Drawing Sheets

(51) Int. Cl.
*E21B 33/072* (2006.01)
*E21B 23/14* (2006.01)

(56) References Cited

U.S. PATENT DOCUMENTS 4,442,908 A * 4/1984 Steenbock ..... E21B 4/00 175/61
4,647,255 A * 3/1987 Pow ..... B21D 9/03 405/168.1
4,739,801 A 4/1988 Kimura et al.
5,254,809 A 10/1993 Martin
5,337,839 A 8/1994 Warren et al.
6,039,081 A 3/2000 Albert
6,220,303 B1 * 4/2001 Secher ..... E21B 17/017 138/110
6,331,129 B1 * 12/2001 Earley ..... E04H 4/143 441/133
6,920,945 B1 * 7/2005 Belew ..... E21B 7/061 166/298
7,062,143 B1 6/2006 Berens et al.
8,245,785 B2 * 8/2012 Peters ..... E21B 4/18 166/298
8,323,297 B2 12/2012 Hinman et al.
8,528,644 B2 * 9/2013 Brunet ..... E21B 4/18 166/298
8,607,826 B2 12/2013 Krohn et al.
9,651,181 B2 * 5/2017 Luce ..... F16L 57/005
9,845,641 B2 * 12/2017 Belew ..... E21B 7/046
9,889,907 B2 * 2/2018 Hubert ..... B63B 21/66
10,041,306 B2 * 8/2018 Wang ..... E21B 17/017
D829,179 S * 9/2018 Whitefield ..... D13/151
10,100,965 B2 * 10/2018 Whitefield ..... F16L 11/18
10,301,885 B2 * 5/2019 Farnes ..... E21B 17/017
10,428,993 B2 * 10/2019 Whitefield ..... F16L 57/005
10,472,900 B2 * 11/2019 Harbison ..... E21B 17/017
2002/0108787 A1 8/2002 Baird
2006/0254827 A1 11/2006 Orban
2006/0283635 A1 * 12/2006 Moody ..... E21B 7/062 175/73
2007/0059954 A1 * 3/2007 Suggs, III ..... F16J 9/16 439/101
2008/0044233 A1 * 2/2008 O'Sullivan ..... E21B 17/017 405/158
2009/0200284 A1 8/2009 Sanchez
2012/0304447 A1 12/2012 Smith et al.
2013/0160988 A1 6/2013 Armstrong et al.
2014/0116675 A1 5/2014 Ocalan et al.
2015/0240573 A1 8/2015 Jacobson et al.
2019/0003267 A1 * 1/2019 Thomas ..... E21B 23/14

FOREIGN PATENT DOCUMENTS

WO 2011096820 A2 8/2011
WO 2014109642 A1 7/2014

* cited by examiner

SEGMENTED BEND-LIMITER FOR SLICKLINE ROPE SOCKETS AND CABLE-HEADS

BACKGROUND

In the oil field, slickline cable is used to introduce a slickline tool into a borehole that may be used for the production of hydrocarbons. The borehole may deviate, such that the borehole may transition, for example, from a vertical region to a horizontal region. Moving the slickline tool from a horizontal orientation to a vertical orientation, for example, without harming (e.g., kinking or breaking) the slickline cable is a challenge.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

While the following disclosure is described in the context of a slickline cable being used in a hydrocarbon well environment, it will be understood that the equipment and techniques described herein are useful in any environment in which it is desired to limit the bend radius of a flexible cable, rope, E-line, fiber optic cable, power cable or similar material. Further, the equipment and techniques described herein may be useful in sea-based production systems, land-based systems, multilateral wells, all types of drilling systems, all types of rigs, measurement while drilling ("MWD")/logging while drilling ("LWD") environments, wired drillpipe environments, coiled tubing (wired and unwired) environments, wireline environments, and similar environments.

Figure 1:
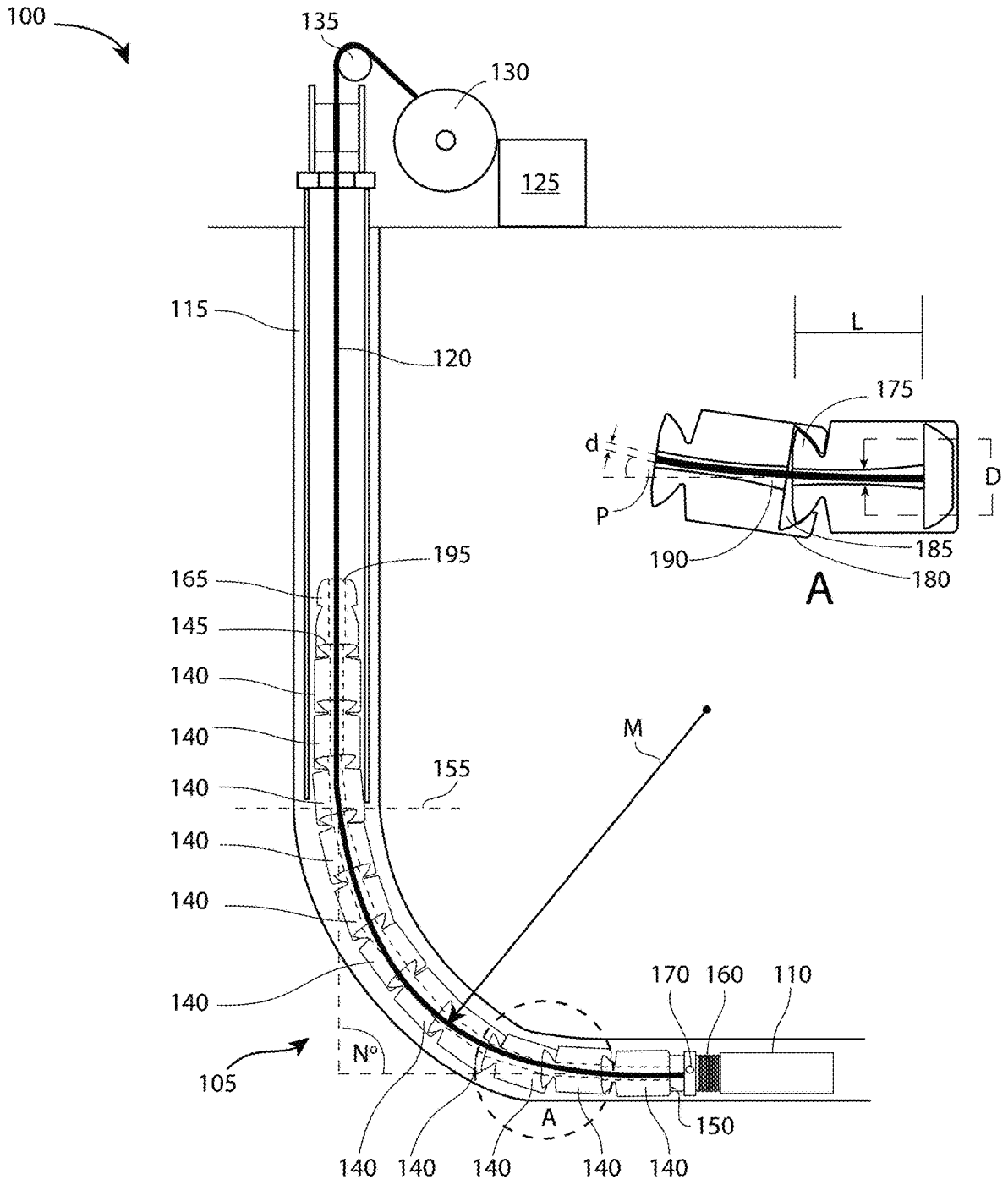
FIG. 1 is an elevation of a slickline system with a chain of bend-limiter segments coupled to a tool deployed into a borehole.

FIG. 1 is an elevation of a slickline system 100 with a chain of bend-limiter segments 105 coupled to a tool 110 deployed into a borehole 115. The slickline system 100 is used to convey the tool 110 (or tools) into the borehole 115, and to retrieve the tool 110 therefrom, using a slickline cable 120. The slickline cable 120, may be thin, hard, and rigid, such as the composite slickline described in WO 2014/137335 (entitled "Bonded Slickline and Methods of Use"), which is assigned to the assignee of the present application, however the slickline system 100 may instead use a wire slickline cable 120 with different material properties and varied physical dimensions. The slickline cable 120 may provide a forward path for signals from the tool 110 to a surface equipment module 125 located on the surface of the earth, or vice versa, as described in U.S. Pat. No. 8,547,246 (entitled "Telemetry System for slickline enabling real time logging"), which is assigned to the assignee of the present application. The slickline cable 120 is stored on a draw works or spool 130 and proceeds through a pulley or system of pulleys 135 and through a packing assembly (not shown).

The slickline cable 120 may be electronically and mechanically coupled to the tool 110. The coupling between the slickline cable 120 and the tool 110 may include a sturdy mechanical connection, capable of sustaining the connection through the entire slickline operation. In one or more embodiments, there is an electronic or optical connection (not shown) between the slickline cable 120 and the tool 110. The tool 110 may include sensors and actuators, such as probes, pressure sensors, and acoustic sensors.

The chain of bend-limiter segments 105 may include a plurality of bend-limiter segments 140. The chain of bend-limiter segments 105 may include a first end 145 and a second end 150. The borehole 115 may bend at a first location 155 causing the chain of bend-limiter segments 105 to bend at the first location 155. In FIG. 1, the bend is shown to be N degrees, where N can be any practical number between 0 and 360. The bend in the borehole 115 causes the slickline cable 120 to bend and undergo stress as the tool traverses the first location 155 through the bend, or vice versa. That is, the slickline cable 120 bends as the tool 110 is inserted into the borehole 115 and as it is withdrawn from the borehole 115. Similarly, the slickline cable 120 may experience similar stresses when the tool 110 is picked up using the slickline cable 120 from a deck on an offshore platform or from the ground at a land-based drilling system. The chain of bend-limiter segments 105 may assist the slickline cable 120 transition through restrictions, such as tubing re-entry guides (not shown.)

Typically, the slickline cable 120 has a minimum radius of curvature specification M, where M is measured in any units of length (English units, scientific units, etc.) below which the slickline cable 120 is susceptible to damage, such as kinking, breaking, or, more generally, experiencing stress that causes the slickline cable 120 to exceed its yield point (i.e., the point at which stress will cause the slickline cable to deform plastically rather than elastically) and permanently deform due to overstressing caused by subjecting the slickline cable 120 to a too-tight radius of curvature. Further, the slickline cable 120 is constrained where it joins to the tool 110, making the slickline cable 120 more susceptible to damage in that area.

To reduce the likelihood of such damage, the chain of bend-limiter segments 105 is coupled to the slickline cable 120 and to the tool 110 to restrict the radius of curvature M of the slickline cable 120 where it joins the tool 110. The chain of bend-limiter segments 105 may include a sucker rod adaptor 160, a fishneck end 165 and shear pins 170 to facilitate coupling the chain of bend-limiter segments 105 to the slickline cable 120 and the tool 110.

As illustrated in the magnified view A of FIG. 1, each bend-limiter segment 140 may include a male end 175 having a male shape. The bend-limiter segment 140 may include a female end 180 couplable to the male end 175 and having a cavity 185. The cavity 185 has a cavity shape that is complementary to the male shape with a restriction in the cavity 185, discussed in more detail below, which confines angular movement of the male shape within the cavity 185 to P degrees from a longitudinal axis through the male end 175 and the female end 180. The total bend allowed by the chain of bend-limiter segments 105 is P multiplied by the number of bend-limiter segments 140 in the chain of bend-limiter segments 140. For example, if P is 10 degrees and there are 9 bend-limiter segments 140, the total bend allowed by the chain of bend-limiter segments 105 is 90 degrees (9×10).

Each bend limiter segment 140 may include a channel 190 having a diameter D through the male end 175 and the female end 180 along the longitudinal axis. The chain of bend-limiter segments 105 may form a passage 195 from the first end 145 to the second end 150. The combined length of the male end 175 and the bottom of the cavity 185 is L. The radius of curvature M is defined by P and L:

$$M = \frac{L}{2\mathrm{Tan}\left(\frac{P}{z}\right)} \tag{1}$$

For small values of P (i.e, P<2 degrees), M can be approximated as:

$$M = \frac{L}{\mathrm{Sin}(P)} \tag{2}$$

For very small values of P (i.e., P<½ degree), M can be approximated as:

$$L/P \tag{3}$$

As can be seen in the equations, M increases as L increases and decreases as P increases.

Figures 2A, 2B, 2C:
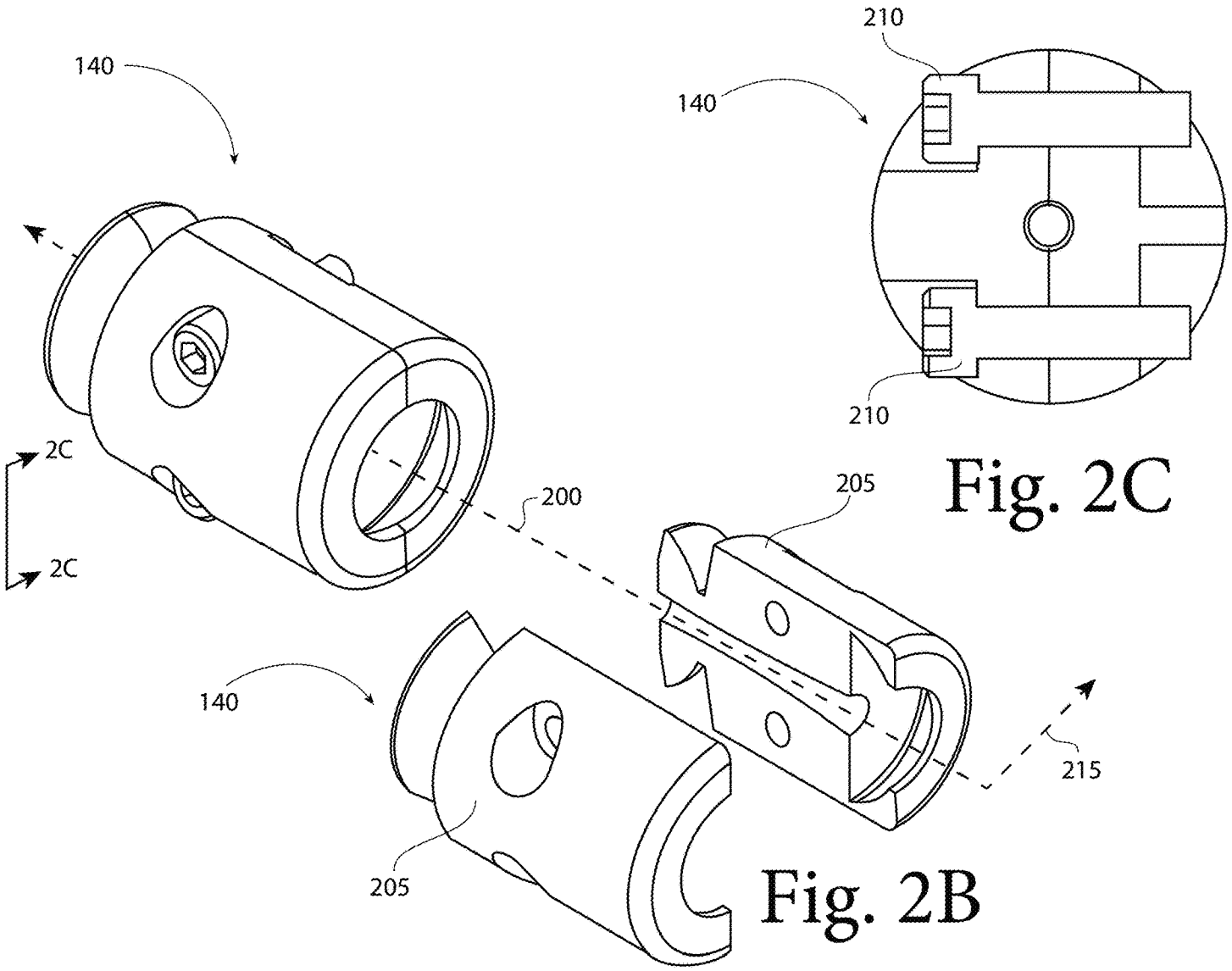
FIG. 2A is a plan view of a bend-limiter segment.
FIG. 2B is a plan view of a bend-limiter segment divided into two sections.
FIG. 2C is a cross-sectional view of the bend-limiter segment of FIG. 2A and FIG. 2B.

FIGS. 2A and 2B are plan views of a bend-limiter segment 140. Each bend-limiter segment 140 may include two halves 205 couplable along a longitudinal axis 200. The two halves 205 may be identical. The bend-limiter segment 140 may also include three or more sections (not shown). The bend-limiter segment 140 may also be a single apparatus not comprising any sections.

FIG. 2C is a cross-sectional view of the bend-limiter segment 140 of FIG. 2A and FIG. 2B. As illustrated in FIG. 2C, the sections 205 may be coupled together by bolts 210 or by other methods (i.e., adhesives, welding). The bolts 210 may couple the sections 205 along an axial axis 215. The longitudinal axis 200 may be substantially perpendicular to the axial axis 215.

The bend-limiter segment 140 may be manufactured from a polymer. The bend-limiter segment 140 may be manufactured from a metal or a similar material.

In order to retrieve the tool 110 from the borehole 115 using the slickline cable 120 while maintaining the minimum radius of curvature M of the slickline cable 120, the bend-limiter segment 140 may be designed and manufactured to meet certain parameters. Those parameters may include the diameter D of the passage 195; the length L and width of each bend-limiter segment 140; and other parameters of the bend-limiter segments 140.

Figure 3A:
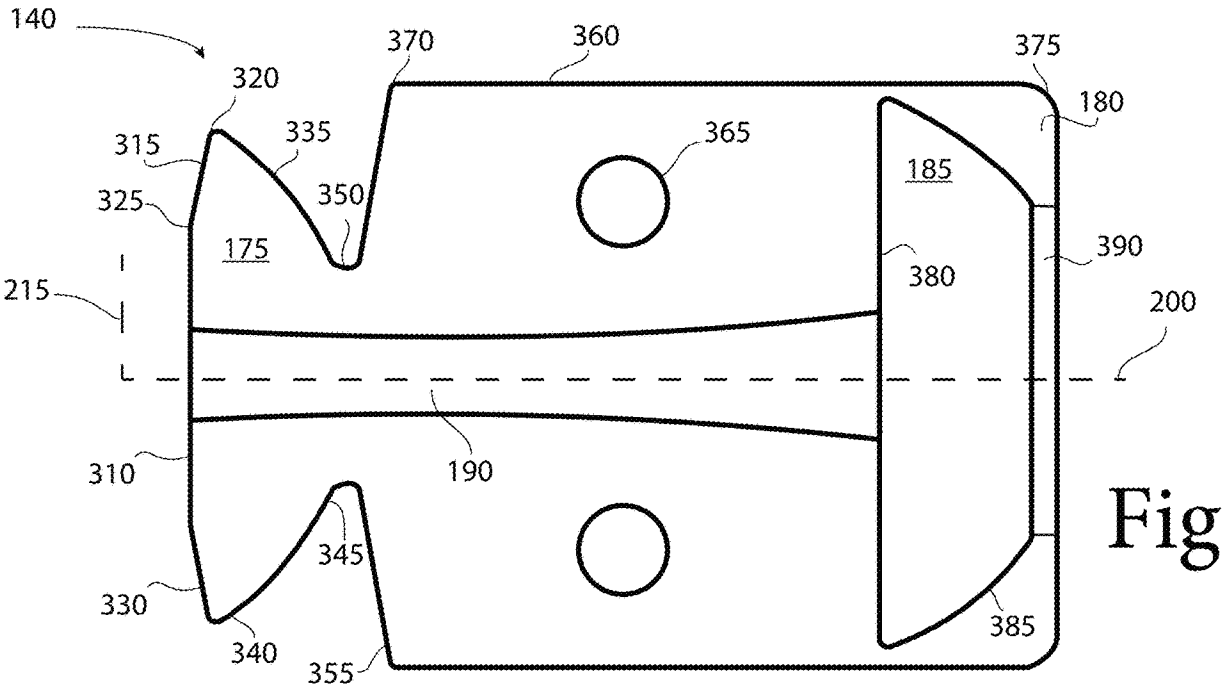
FIG. 3A is a cross-sectional view of the bend-limiter segment of FIG. 2A and FIG. 2B.

An example of a bend-limiter segment 140 is illustrated in FIG. 3A, which is a cross-sectional view of a bend-limiter segment 140. As previously mentioned, the bend-limiter segment 140 may have a male end 175. The male end 175 may be positioned along the longitudinal axis 200. The male end 175 may have a ball joint. The male end 175 may have a conical shape. The male end 175 may have a bowl shape. The male end 175 may have a parabolic shape. The male end 175 may have a tapered shape.

The male end 175 have may have a crown surface 310 that is substantially parallel to the axial axis 215. The crown surface 310 may have a flat surface. The crown surface 310 may integrate with a crown rocker 315. The crown rocker 315 may have the shape of a truncated cone with a crown rocker large end 320 and a crown rocker small end 325. The crown rocker small end 325 may integrate with the crown surface 310. The area of the crown rocker large end 320 is greater than the area of the crown rocker small end 325. There may be a sloped surface 330 between the crown rocker small end 325 and the crown surface 310.

The crown rocker 315 may be integral with a truncated cone 335. The truncated cone 335 may be substantially positioned along the longitudinal axis 200. The outer surface of the truncated cone 335 may have a conical shape. The outer surface of the curved truncated cone 335 may have a parabolic shape. The truncated cone 335 may be truncated at a desired length. The dimensions of the curved truncated cone 335 may be one of the factors that define the maximum angle P that can be achieved between the longitudinal axis 200*a* through one of the bend-limiter segments 140 and the longitudinal axis 200*b* through the other bend-limiter segment 140.

The curved truncated cone 335 may have a bottom surface 340 integral with the crown rocker 315 and a top surface 345 integral with a neck 350 (discussed below). The bottom surface 340 is opposite the top surface 345. The curved truncated cone 335 may decrease in diameter along the longitudinal axis 200 starting from the bottom surface 340 to the top surface 345. The short dimension of the curved truncated cone 335 may be substantially parallel to the longitudinal axis 200. The long dimension of the truncated cone 335 may be substantially parallel to the axial axis 215.

The truncated section of the curved truncated cone 335 may be integral with a neck 350. The neck 350 may be positioned substantially along the longitudinal axis 200. The neck 350 may have substantially the same area as the truncated section of the curved truncated cone 335. The neck 350 may have a substantially cylindrical shape. The neck 350 may have the shape of a cylinder flared on both ends. The neck 350 may integrate with a shoulder 355.

The shoulder 355 is substantially positioned along the axial axis 215. The shoulder 355 may have the shape of a truncated cone. The shoulder 355 integrates with the neck 355 at one end and with a body 360 at the other end.

The body 360 may be cylindrical. The body 360 may have a cap screw hole 365 for placing the screw bolts 210. The cap screw hole 365 is bored through the body 360. The body 360 may have a plurality of cap screw holes 365. The body 360 may have a top end 370 and a bottom end 375. The body top end 370 may be integrated with the shoulder 355. The body bottom end 375 may be integral with the female end 180.

The female end 180 may include a cavity 185. The cavity 185 may be positioned substantially along the longitudinal axis 200 and opposite the male end 175. The cavity 185 may have a cavity bottom surface 380 positioned substantially along the axial axis 215. The cavity bottom surface 380 may have substantially the same surface area as the crown rocker large end 320.

The cavity 185 may also include a cavity wall 385 integrated with the cavity bottom surface 380. The cavity wall 385 may be adjacent the cavity bottom surface 380. The cavity wall 385 may have substantially the same shape as the curved truncated cone 335. The cavity 185 may have a conical shape. The cavity 180 may have a bowl shape. The cavity 180 may have a parabolic shape. The cavity 180 may be tapered.

The cavity 180 may have a cavity opening 390 positioned substantially along the axial axis 215 and opposite the cavity bottom surface 380. The cavity opening 390 may be large enough to allow the male end 175 to rotate sufficiently in the cavity 185 to achieve the angle P, as shown in FIG. 3B.

The bend-limiter segment 140 may include the channel 190. The channel 190 may be positioned substantially along the longitudinal axis 200. The channel 190 may traverse the entire length of the bend-limiter segment 140. The channel 190 may have a diameter at the male end 175 that gradually reduces as it traverses the body 360, and then gradually increases as it exits the female end 180.

Figure 3B:
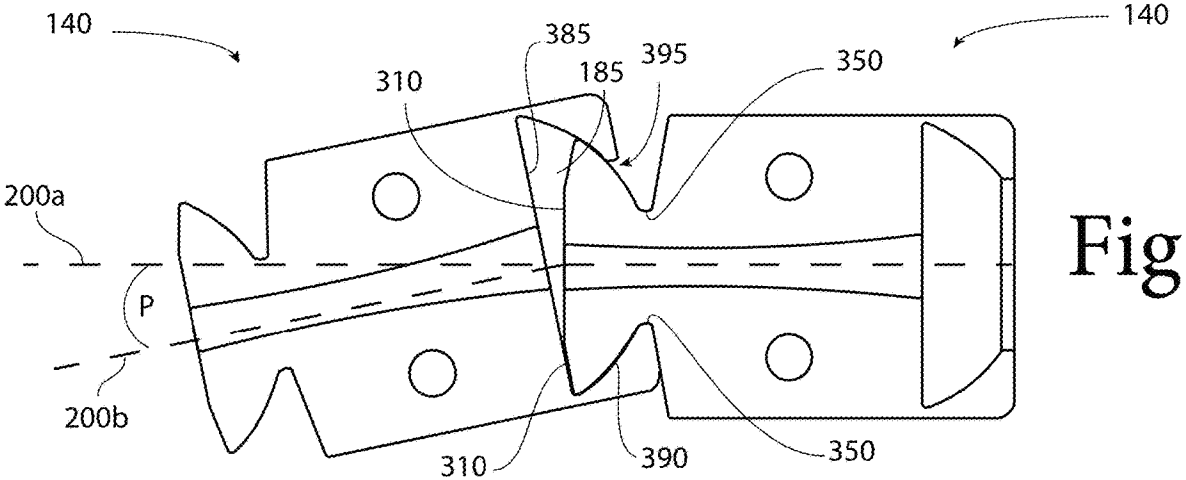
FIG. 3B is a cross-sectional view of two bend-limiter segments of FIG. 2A and FIG. 2B coupled together.

FIG. 3B is a cross-sectional view of multiple bend-limiter segments 140 of FIG. 2A and 3B coupled together. The restriction in the cavity 185 that restricts movement of bend-limiters 140 relative to each other is provided by the interaction between the crown rocker surface 310, the crown rocker 315, the neck 345, the cavity bottom surface 380, and the cavity wall 385.

Figure 4B:
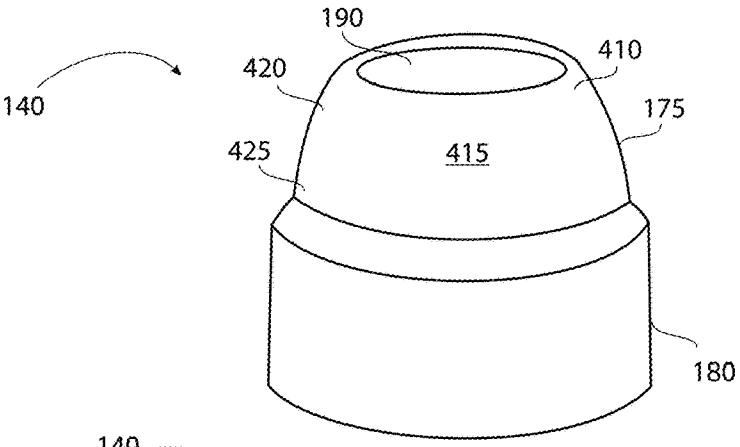
FIG. 4B is a plan view of a bend-limiter segment.
Figure 4C:
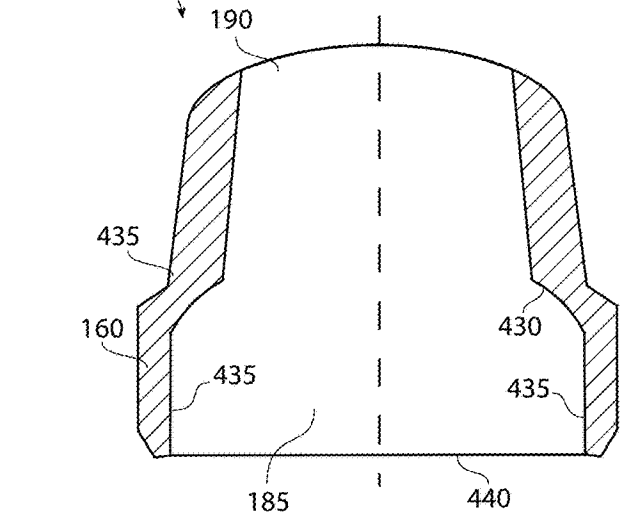
FIG. 4C is a cross-sectional view of the bend-limiter segment of FIG. 4B.
Figure 4A:
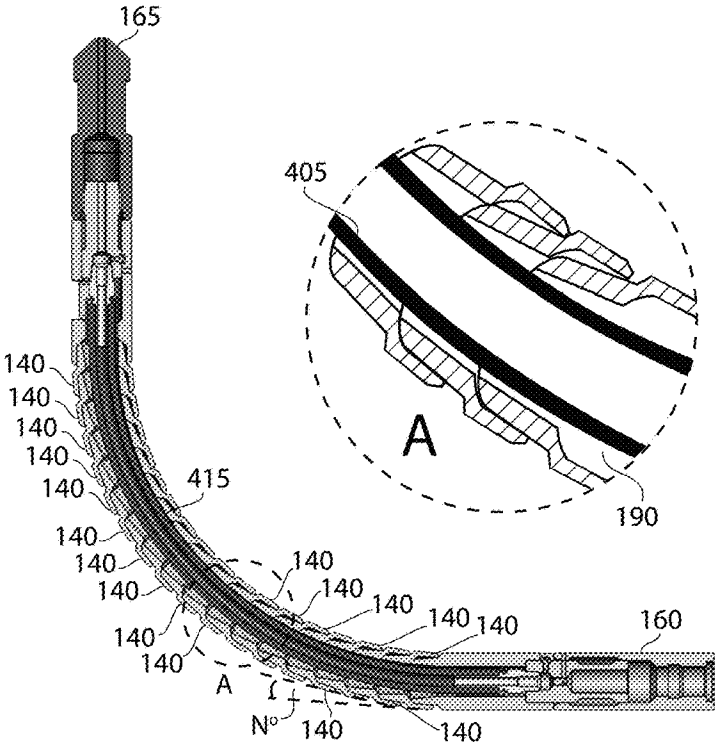
FIG. 4A is cross-sectional view of a chain of bend-limiter segments.

Another example of the chain of bend-limiter segments 105 is illustrated in FIGS. 4A-4C. FIG. 4A is a cross-sectional view of a chain of bend-limiter segments 105. The chain of bend-limiter segments 105 may include an external fishneck 165 coupled to either end of the chain of bend-limiter segments 105. The chain of bend-limiter segments 105 may include a slickline sucker rod adaptor 160 coupled to either end of the chain of bend-limiter segments 105. The chain of bend-limiter segments 105 may include a non-metallic hose 405 (also illustrated in magnified view A of FIG. 4A). The non-metallic hose 405 may traverse the entire length of the chain of bend-limiter segments 105 through the passage created by the channels 190.

FIG. 4B is a plan view of the bend-limiter segment 140 shown in FIG. 4A. The bend-limiter segment 140 may include the male end 175. The male end 175 may include a dome 410. The male end 175 may include a base 415. The base 415 may have the shape of a tapered cylinder flared at one end. The base 415 may include a base top end 420, which may be integrated with the dome 410. The base 415 may include a base bottom end 425. The base bottom end 425 may be flared such that it has a surface area larger than the base top end 420. The male end 175 may include the channel 190.

FIG. 4C is a cross-sectional view of the bend-limiter segment of FIG. 4B. The bend-limiter segment 140 may include the female end 180. The female end 180 may include the cavity 185. The cavity 185 may have a cavity bottom surface 430. The cavity bottom surface 430 may have a shape substantially the same shape as the dome 410. The cavity 185 may include a cavity wall 435. The cavity wall 435 may be adjacent to the cavity bottom surface 430. The cavity wall 435 may have substantially the same shape as the base 415. The cavity 185 may include a cavity opening 440. The cavity opening 440 may be opposite the cavity bottom surface 430. The cavity opening 440 may be adjacent the cavity wall 435. The cavity opening 440 may have substantially the same surface area as the base bottom end 425.

When two or more bend-limiter segments 140 are coupled together, as illustrated in FIG. 4A, the restriction in the cavity 185 that restricts movement of bend-limiters 140 relative to each other is provided by the interaction of the dome 410, the base 415, the cavity wall 435, and the cavity bottom surface 430

Figures 5A, 5B, 5C:
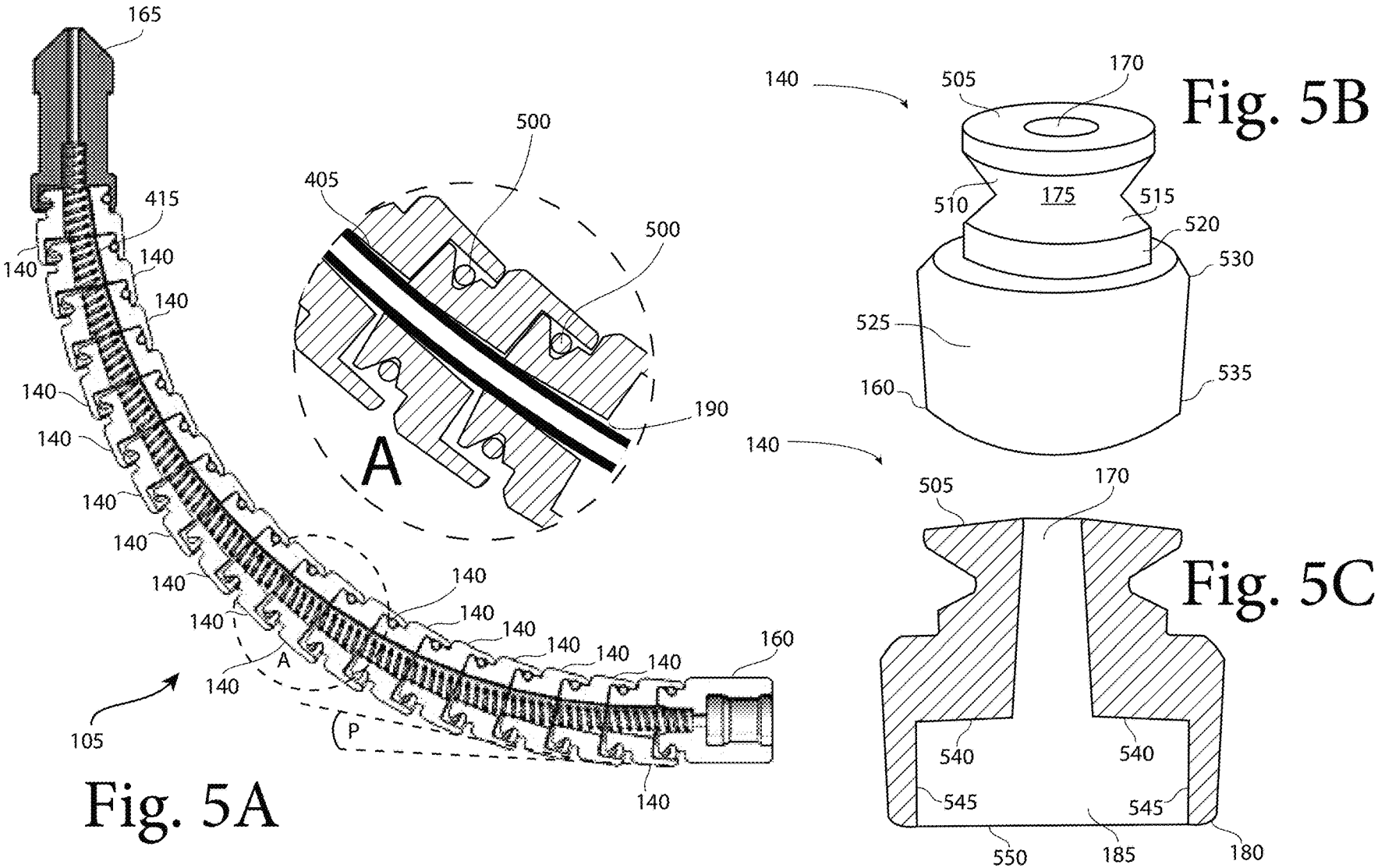
FIG. 5A is a cross-sectional view of a chain of bend-limiter segments.
FIG. 5B is a plan view of a bend-limiter segment.
FIG. 5C is a cross-sectional view of the bend-limiter segment of FIG. 5B.

Another example of the chain of bend-limiter segments 105 is illustrated in FIGS. 5A-5C. FIG. 5A is a cross-sectional view of a chain of bend-limiter segments 105. The chain of bend-limiter segments 105 may include the external fishneck 165 coupled to either end of the chain of bend-limiter segments 105. The chain of bend-limiter segments 105 may include the slickline sucker rod adaptor 160 coupled to either end of the bend-segments 140. The chain of bend-limiter segments 105 may include the non-metallic hose 405 (also illustrated in the magnified view A of FIG. 5A). The non-metallic hose 405 may traverse the entire length of the chain of bend-limiter segments 105 through the passage created by the channel 190. The chain of bend-limiter segments 105 may include snap rings 500. The snap rings 500 may be coupled externally to male end 175. The snap rings 500 may be coupled internally to the cavity 185.

FIG. 5B is a plan view of a bend-limiter segment. The bend-limiter segment 140 may include the male end 175. The male end 175 may include a convex surface 505.

The male end 175 may include a first truncated cone 510. A large end of the first truncated cone 510 may be integral to the convex surface 505. The male end 175 may include a truncated sphere (not shown). The male end 165 may include a second truncate cone 515. The small end of the first truncated cone 510 may be integral with a small end of the second truncated cone 515.

The male end 175 may include a neck 520. The large end of the second truncated cone 515 may be integral to the neck 520. The neck 520 may be cylindrical.

The male end 175 may include a male end link 525. The male end link 525 may be cylindrical. The male end link 525 may include a link top end 530. The link top end 530 may be integrated with the neck 520. The male end link 525 may include a link bottom end 535 opposite the link top end 530. The link top end 530 may have a surface area larger than the neck 520. The link top end 530 may have a surface area larger than the link bottom end 535.

FIG. 5C is a cross-sectional view of the bend-limiter segment of FIG. 5B. The bend-limiter segment 140 may include the female end 180. The female end 180 may include the cavity 185. The cavity 185 may include a cavity bottom surface 540. The cavity bottom surface 540 may have substantially the same shape as the convex surface 505. The cavity bottom surface 540 may have a concave surface.

The cavity 185 may include a cavity wall 545. The cavity wall 545 may be adjacent the cavity bottom surface 540. The cavity wall 545 may be substantially perpendicular to the cavity bottom surface 540. The cavity wall 545 may have substantially the same shape as the male end link 525.

The cavity 185 may include a cavity opening 550, as illustrated in FIG. 5C. The cavity opening 550 may have substantially the same surface area as the convex surface 505. The cavity 375 may have an area substantially the same as the male end 175.

When two or more bend-limiter segments 140 are coupled together, as illustrated in FIG. 5A, the restriction in the cavity 185 that restricts movement of the bend-limiters 140 relative to each other is provided by the interaction of the convex surface 505, the truncated cone neck 520, the cavity bottom surface 540, and the cavity wall 545.

Figure 6:
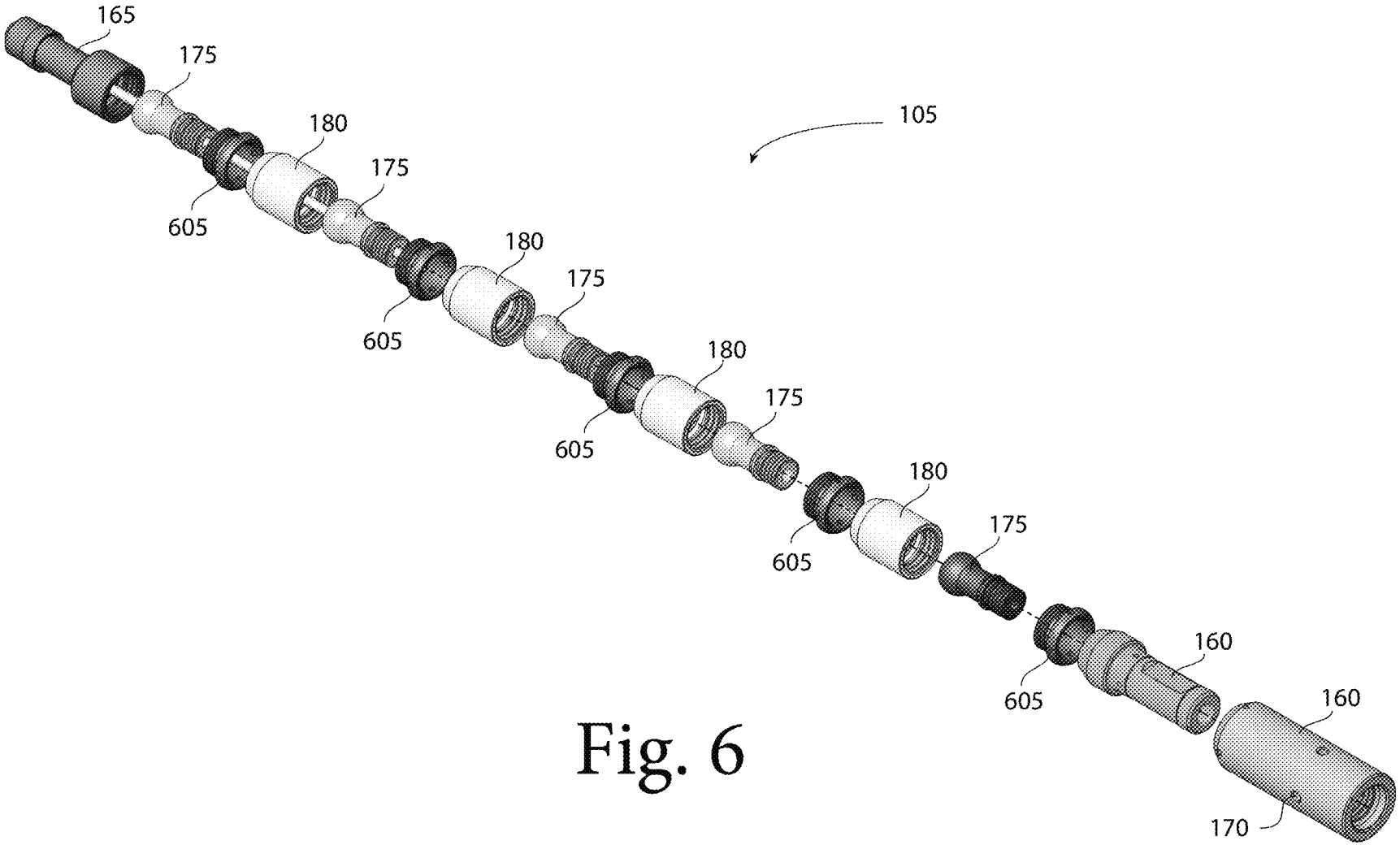
FIG. 6 is an exploded plan view of a chain of bend-limiter segments with a spanner hole assembly.

Another example of the chain of bend-limiter segments 105 is illustrated in FIGS. 6, and 7A-7C. FIG. 6 is an exploded plan view of a chain of bend-limiter segments 105. The chain of bend-limiter segments 105 may include the external fishneck 165 coupled to either end of the chain of bend-limiter segments 105. The chain of bend-limiter segments 140 may include the slickline sucker rod adaptor 160 coupled to either end of the chain of bend-segments 105.

The chain of bend-limiter segments 105 may include the male end 175. The chain of bend-limiter segments 105 may include the female end 180. The chain of bend-limiter segments 105 may include a collar 605 (discussed below in connection with FIGS. 7A-7C). The chain of bend-limiter segments 105 may include shear pins 170 (discussed below in connection with FIG. 7A).

Figures 7A, 7B, 7C:
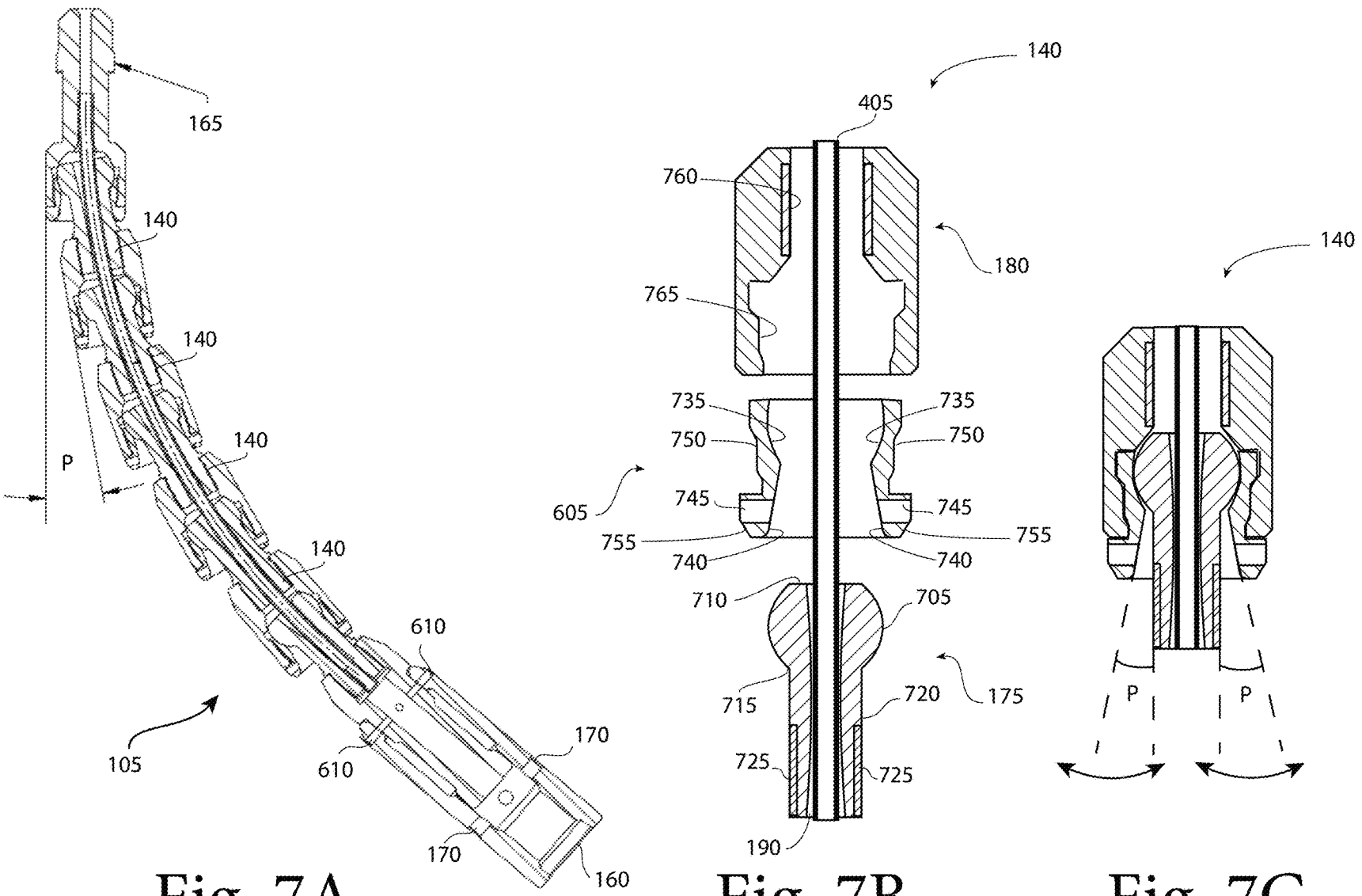
FIG. 7A is a cross-sectional view of a chain of bend-limiter segments with a spanner hole assembly.
FIG. 7B is an exploded cross-sectional view of a bend-limiter segment with a spanner hole assembly.
FIG. 7C is a cross-sectional view of a bend-limiter segment with a spanner hole assembly.

FIG. 7A is a cross-sectional view of a chain of bend-limiter segments 105. The shear pins 170 may be coupled to the slickline sucker rod adaptor 145. The shear pins 170 may be positioned along the longitudinal axis 200 and /or the axial axis 215 (not shown). In cases where the tool 110 is stuck in the borehole 115, an operator (not shown) may "jar" the slickline cable 120, shearing the shear pins 170, and retract the chain of bend-limiter segments 105 from the borehole 115.

FIG. 7B is an exploded cross-sectional view of a bend-limiter segment 105. The bend-limiter segment 140 may include the male end 175. The male end 175 may include a truncated sphere 705. The truncated sphere 705 may be truncated at a desired length on opposite sides of the truncated sphere 705. The truncated sphere 705 may include a truncated top end 710. The truncated sphere 705 may include a truncated bottom end 715.

The bend-limiter segment 140 may include a shaft 720. The shaft 720 may be coupled to the truncated bottom end 715. The shaft 720 may be a cylindrical. The shaft 720 may have a threaded end 725.

The bend-limiter segment 140 may include the channel 190 that traverses the entire length of the male end 175. The channel 190 may have a diameter that decreases as it traverses the truncated sphere 705 and increases as it exits the shaft 720. The channel 190 may include the non-metallic hose 405. The non-metallic hose 405 may traverse the entire length of the bend-limiter segment 140 and/or the chain of bend-limiter segments 105.

The bend-limiter segment 140 may include the collar 605. The collar 605 may have a top collar cavity 735 that has substantially the same shape as the truncated sphere 705. The collar 730 may include a bottom collar cavity 740. The bottom collar cavity 740 has a diameter that is larger than the shaft 720 to allow the male end to swivel within the bottom collar cavity 740 and the top collar cavity 735. The collar 605 may include spanner holes 745. The spanner holes may allow a spanner wrench to remove the collar 730 from the female end 180.

The collar 605 may include a collar neck 750. The collar neck 750 may include an irregular exterior. The collar neck 750 may be threaded. The collar 605 may include a collar shoulder 755. The collar shoulder 755 may be coupled to the collar neck 750. The collar shoulder 755 may be integral with the collar neck 750. The collar shoulder 755 may have an outside diameter that is greater than the collar neck's 750 outside diameter.

The bend-limiter segment 140 may include the female end 180. The female end 180 may include a clasp end 760. The clasp end may be threaded. The female end 180 may include a receptacle end 765 opposite the clasp end 760. The receptacle end 765 may be threaded. The receptacle end 765 has an internal shape that is complimentary to the external shape of the collar 605.

FIG. 7C is a cross-sectional view of a bend-limiter segment 140. When two or more bend-limiter segments 140 are coupled together, as illustrated in FIG. 7C, the restriction in the cavity 185 that restricts movement of bend-limiters 140 relative to each other is provided by the interaction of the truncated sphere 705, the shaft 720, the collar 605, the female end 180.

Figure 8:
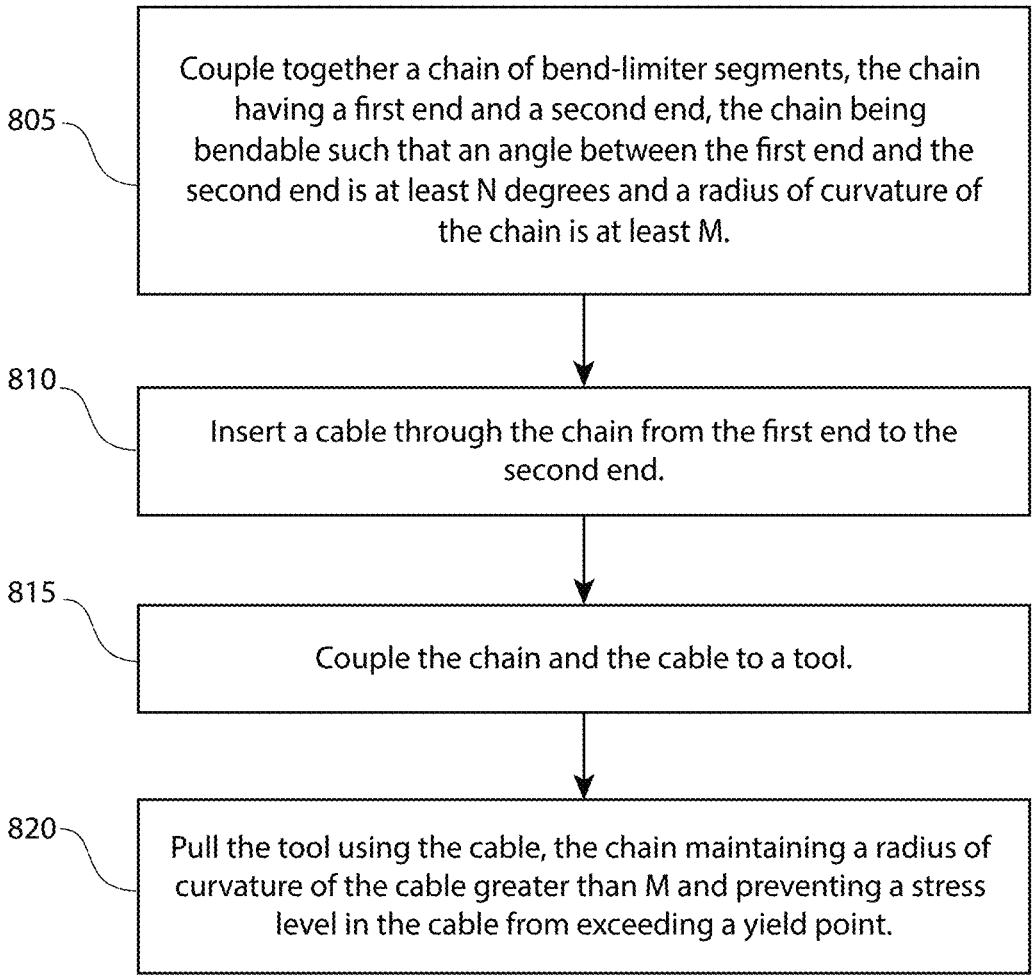
FIG. 8 is a flow chart.

FIG. 8 is a flow chart. A technique for limiting the bend in a cable includes coupling together a chain of bend-limiter segments (such as chain of bend-limiter segments 105). The chain has a first end (such as first end 145) and a second end (such as second end 150). The chain is bendable such that an angle between the first end (such as first end 145) and the second end (such as second end 150) is at least N degrees and a radius of curvature of the chain is at least M (block 805). A cable (such as cable 120) may be inserted through the chain (such as chain of bend-limiter segments 105) from the first end (such as first end 140) to the second end (such as second end 150) (block 810). A chain (such as chain of bend-limiter segments 105) and a cable (such as cable 120) may be coupled to a tool (such as tool 110) (block 815). The tool (such as tool 110) may be pulled using the cable (such as cable 120), the chain maintaining a radius of curvature of the cable (such as cable 120) greater than M and preventing a stress level in the cable (such as cable 120) from exceeding a yield point (block 820).

In one aspect, a method features coupling together a chain of bend-limiter segments, the chain having a first end and a second end, the chain being bendable such that an angle between the first end and the second end is at least N degrees and a radius of curvature of the chain is at least M. A cable is inserted through the chain from the first end to the second end. The chain and the cable are coupled to a tool. The tool is pulled using the cable. The chain maintains a radius of curvature of the cable greater than M and prevents a stress level in the cable from exceeding a yield point.

Implementations may include one or more of the following. The cable may be coupled to a surface equipment. The chain of bend-limiter segments, the tool, and the cable may be deployed into a borehole, past a first location where the borehole deviates. Pulling the tool using the cable may include retrieving the tool from the deviated borehole when the tool passes through the first location. Pulling the tool using the cable may include lifting the tool from a first orientation to a second orientation different from the first orientation using the cable. Coupling together a chain of bend-limiter segments may include coupling two or more bend-limiter segments. Coupling together a chain of bend-limiter segments may include dividing the bend limiter segments into two or more halves. Coupling together a chain of bend-limiter segments may include mounting the two or more halves about the cable. Coupling together a chain of bend-limiter segments may include securing the two or more halves to the cable.

In one aspect, an apparatus features a chain of bend-limiter segments, the chain of bend-limiter segments having a first end and a second end. The chain of bend-limiter segments is bendable such that an angle between a first end and a second end is at least N degrees. A radius of curvature of the chain of bend-limiter segments is M when the angle between the first end and the second end is N degrees. N and M are determined by parameters of the bend-limiter segments. The bend-limiter segments have channels such that the chain of bend-limiter segments has a passage from the first end to the second end.

Implementations may include one or more of the following. The bend-limiter segments may include a male end having a male shape. A female end may be coupled to the male end. The female end may have a cavity with a cavity shape that is complementary to the male shape with a restriction in the cavity that confines angular movement of the male shape within the cavity to P degrees from a longitudinal axis through the male end and the female end. The bend-limiter segments may include a channel having a diameter D through the male end and the female end along the longitudinal axis.

In one aspect, a system features a surface equipment located on a surface of the earth. The system includes a tool coupled to the cable. The system includes a bend-limiter coupled to the cable adjacent the tool. The bend-limiter includes a chain of bend-limiter segments, the chain of bend-limiter segments having a first end and a second end. The chain of bend-limiter segments is bendable such that an angle between the first end and the second end is at least N degrees. A radius of curvature of the chain of bend-limiter segments is M when the angle between the first end and the second end is N degrees. N and M are determined by parameters of the bend-limiter segments. The bend-limiter segments have channels such that the chain of bend-limiter segments has a passage from the first end to the second end.

Implementations may include one or more of the following. The chain of bend-limiter segments may include a first end and a second end. The chain of bend-limiter segments may be bendable such that an angle between a first end and a second end is at least N degrees. A radius of curvature of the chain of bend-limiter segments may be M when the angle between the first end and the second end is N degrees. N and M may be determined by parameters of the bend-limiter segments. The bend-limiter segments may include a male end having a male shape. The bend-limiter segment may include a female end coupled to the male end and having a cavity with a cavity shape that is complementary to the male shape with a restriction in the cavity that confines angular movement of the male shape within the cavity to P degrees from a longitudinal axis through the male end and the female end. The bend-limiter segment may include a channel having a diameter D through the male end and the female end along the longitudinal axis.

References in the specification to "one or more embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method comprising:

coupling together a chain of a plurality of bend-limiter segments, the chain having a first end and a second end, the chain being bendable to form an angle between the first end and the second end and a radius of curvature of the chain;

inserting a cable through the chain from the first end to the second end;

coupling the cable to a tool;

coupling the chain to the tool and around the cable where the cable is coupled to the tool; and pulling the tool using the cable, the chain maintaining a radius of curvature of the cable greater than a minimum radius of curvature and preventing a stress level in the cable from exceeding a yield point.

2. The method of claim 1 further comprising:

coupling the cable to a surface equipment;

deploying the chain of bend-limiter segments, the tool, and the cable into a borehole, past a first location where the borehole deviates;

wherein pulling the tool using the cable comprises retrieving the tool from the deviated borehole when the tool passes through the first location.

3. The method of claim 1 wherein pulling the tool using the cable comprises lifting the tool from a first orientation to a second orientation different from the first orientation using the cable.

4. The method of claim 1 wherein coupling together a chain of bend-limiter segments comprises coupling two or more bend-limiter segments.

5. The method of claim 1 wherein coupling together a chain of bend-limiter segments comprises:

dividing the bend-limiter segments into two or more halves;

mounting the two or more halves about the cable; and securing the two or more halves to the cable.

6. A system comprising:

a surface equipment located on a surface of the earth;

a cable having a surface end coupled to the surface equipment and a downhole end extending into a borehole;

a tool coupled to the downhole end of the cable;

a bend limiter coupled around the cable where the downhole end of the cable couples to the tool, the bend limiter having:

a chain of a plurality of bend-limiter segments, the chain of bend-limiter segments having a first end and a second end;

the chain of bend-limiter segments being bendable to form an angle between the first end and the second end and a radius of curvature of the chain;

the chain being coupled to the tool and around the cable where the cable is coupled to the tool; and the bend-limiter segments having channels such that the chain of bend-limiter segments has a passage from the first end to the second end.

7. The system of claim 6 wherein the chain of bend-limiter segments comprise a first end and a second end; and wherein:

the chain of bend-limiter segments is bendable to form an angle between a first end and a second end.

8. The system of claim 6 wherein the bend-limiter segments comprise:

a male end having a male shape;

a female end coupled to the male end and having a cavity with a cavity shape that is complementary to the male shape with a restriction in the cavity that confines angular movement of the male shape within the cavity; and a channel having a diameter through the male end and the female end along the longitudinal axis.

* * * * *